US012082706B2

(12) United States Patent
Hanh

(10) Patent No.: US 12,082,706 B2
(45) Date of Patent: Sep. 10, 2024

(54) WAIST SUPPORT CHAIR

(71) Applicant: T Tiet Hanh, Chino Hills, CA (US)

(72) Inventor: T Tiet Hanh, Chino Hills, CA (US)

( * ) Notice: Subject to any disclaimer, the term of this patent is extended or adjusted under 35 U.S.C. 154(b) by 106 days.

(21) Appl. No.: 17/882,958

(22) Filed: Aug. 8, 2022

(65) Prior Publication Data

US 2024/0041213 A1 Feb. 8, 2024

(51) Int. Cl.
*A47C 7/14* (2006.01)

(52) U.S. Cl.
CPC ..... *A47C 7/142* (2018.08)

(58) Field of Classification Search
CPC ..... B60N 2/914; B60N 2/5642; B60N 2/66; B60N 2/2222; A47C 1/022; A47C 27/144
USPC ..... 297/452.22, 283.3, 284.4
See application file for complete search history.

(56) References Cited

U.S. PATENT DOCUMENTS 6,546,578 B1 * 4/2003 Steinmeier ..... B60N 2/7035 5/724
9,758,079 B2 * 9/2017 Zouzal ..... B60N 2/0244
11,076,698 B2 * 8/2021 Munechika ..... B60N 2/665
11,135,946 B2 * 10/2021 Lodhia ..... B60N 2/914
11,453,320 B1 * 9/2022 Powell ..... B60N 2/803
2011/0126356 A1 * 6/2011 Steppat ..... A47C 27/148 267/153

* cited by examiner

*Primary Examiner* — Sarah B McPartlin
(74) *Attorney, Agent, or Firm* — Birch, Stewart, Kolasch & Birch, LLP

(57) ABSTRACT

A waist support chair includes a framework, a back support member, and a hips support member. The framework includes a back support frame and a chair bottom pivotally coupled to each other. The back support member is arranged on the back support frame and adjacent to the chair bottom. The back support member includes two upper support elements horizontally disposed and left-right symmetric to each other and two lower support elements horizontally disposed and left-right symmetric to each other. Two lower support elements are disposed between two upper support elements and the chair bottom. The hips support member is arranged on the chair bottom and includes a plurality of hollow elastic columns. When pressure is applied to the hollow elastic columns, the hollow elastic columns are compressed to release air.

10 Claims, 8 Drawing Sheets

WAIST SUPPORT CHAIR

BACKGROUND OF THE INVENTION

Field of the Invention

The present invention relates to a chair, particularly to a waist support chair.

Description of the Prior Art

Although the advance in science and technology sets people free from manual labor, people spend more time on electronic products and sit at a desk working for a longer time. People sitting for a long time are likely to adjust the position of the hips to maintain sitting comfortably. In addition, people are likely to sit on the front half to the front two-thirds of the seat. In such a situation, a chair back is unlikely to support the back and the waist. Consequently, more and more people suffer from waist diseases that are unexpected in their ages.

Although many ergonomic office chairs available in the market are claimed to be able to provide support for the back and waist, they cannot contact the S-shaped spine intimately because the waist support structure thereof is not sufficiently convex. Even if able to provide sufficient support for the waist, the waist support structures might be excessively convex and make the user's back contact the chair back intimately.

Accordingly, the present invention proposes a waist support chair, which provides back support and waist support separately, to solve the conventional problems and meet future requirements. The principles and embodiments of the present invention are described in detail below.

SUMMARY OF THE INVENTION

The primary objective of the present invention is to provide a waist support chair, which uses an upper support member and a lower support member to respectively support the back and the rear waist of the human body. Each of the upper support member and the lower support member is left-right symmetric, whereby to touch the waist of the human body more intimately and compliantly.

Another objective of the present invention is to provide a waist support chair, wherein a plurality of hollow elastic columns is vertically arranged on the chair bottom to support the hips of the sitter. While the pressure is applied to the hollow elastic columns, the hollow elastic columns are compressed to release air. Thus, the hips of the sitter feels relaxed and comfortable.

In order to achieve the abovementioned objectives, the present invention proposes a waist support chair, which comprises a framework including a back support frame and a chair bottom, which are pivotally coupled to each other; a back support member arranged on the back support frame and adjacent to the chair bottom and including two upper support elements horizontally disposed and left-right symmetric to each other and two lower support elements also horizontally disposed and left-right symmetric to each other, wherein two lower support elements are disposed between two upper support elements and the chair bottom; and a hips support member arranged on the chair bottom and including a plurality of hollow elastic columns, which are compressed to release air while pressurized.

In one embodiment, a back cushion is arranged on one side of the back support frame, and a hips cushion is arranged on one side of the chair bottom.

In one embodiment, two upper support elements are arranged between the back cushion and the back support frame; each upper support element includes an upper connection portion fixed to the back support frame; a plurality of support planes intimately contacting the back cushion to support the back cushion; and a plurality of elastic support bands, wherein one end of each of the elastic support bands is connected with the upper connection portion, and the other end of each of the elastic support bands is connected with a corresponding one of the support planes;

when any one of the support planes is applied with pressure, the support plane moves backward, and the elastic support bands corresponding to the support plane are bent and feeds back a counterforce to the support plane.

In one embodiment, two lower support elements are arranged between the back cushion and the back support frame, and each of the two upper support elements includes a lower connection portion fixed to the back support frame; a plurality of support planes intimately contacting the back cushion to support the back cushion; and a plurality of elastic support bands, wherein one end of the elastic support band is connected with the lower connection portion, and the other end of the elastic support band is connected with a corresponding one of the support planes; when any one of the support planes is applied with pressure, the support plane is moves backward, and the elastic support band corresponding to the support plane are bent and feeds back a counterforce to the support plane.

In one embodiment, a plurality of slots is used to partition an integral plane into a plurality of support planes, and the quantity of the slots corresponds to the quantity of the support planes.

In one embodiment, the chair bottom includes a plurality of ventilation holes, and the ventilation hole has an opening facing the hips cushion and penetrating the chair bottom.

In one embodiment, the hollow elastic columns are disposed in array and vertical to the chair bottom.

In one embodiment, the hollow elastic columns are in form of hexagonal prisms.

In one embodiment, one end of each hollow elastic column is arranged on the chair bottom, and each hollow elastic column includes an air-release hole traveling through a central axis of the hollow elastic column; and a plurality of air-release branch holes arranged on a surface of one end of the hollow elastic column, which is far away from the chair bottom, interconnecting with the air-release hole, and extended outward with the air-release hole being an axis to form a plurality of air flow channels.

In one embodiment, a gap among four of the hollow elastic columns being neighboring forms an ischium support point.

DETAILED DESCRIPTION OF THE INVENTION

The technical schemes of the embodiments of the present invention are described clearly and fully in cooperation with the attached drawings. Obviously, the embodiments described in the specification are not all the embodiments of the present invention but only a portion of the embodiments of the present invention. The other embodiments made by the persons skilled in the art according to the technical thoughts of the present invention are regarded as not contributing non-obviousness and are to be also included in the scope of the present invention.

It should be understood that the terms "comprise" and "include" used in the specification and claims only indicate the existence of characteristics, entireties, steps, operations, elements and/or components but do not exclude the existence or addition of one or more other characteristics, entireties, steps, operations, elements and/or components.

It should be also understood that the terms used in the specification of the present invention are only to describe specified embodiments but not to limit the scope of the present invention. While used in the specification and claims of the present invention, the singular noun, which is described by "one", "one piece of" or "the", implies the plural form thereof unless the context indicates another condition clearly.

It should be further understood: the term "and/or" used in the specification and claims of the present invention refers to one or several of the listed items or any possible combination of the listed items, and the present invention includes these combinations.

Figure 1:
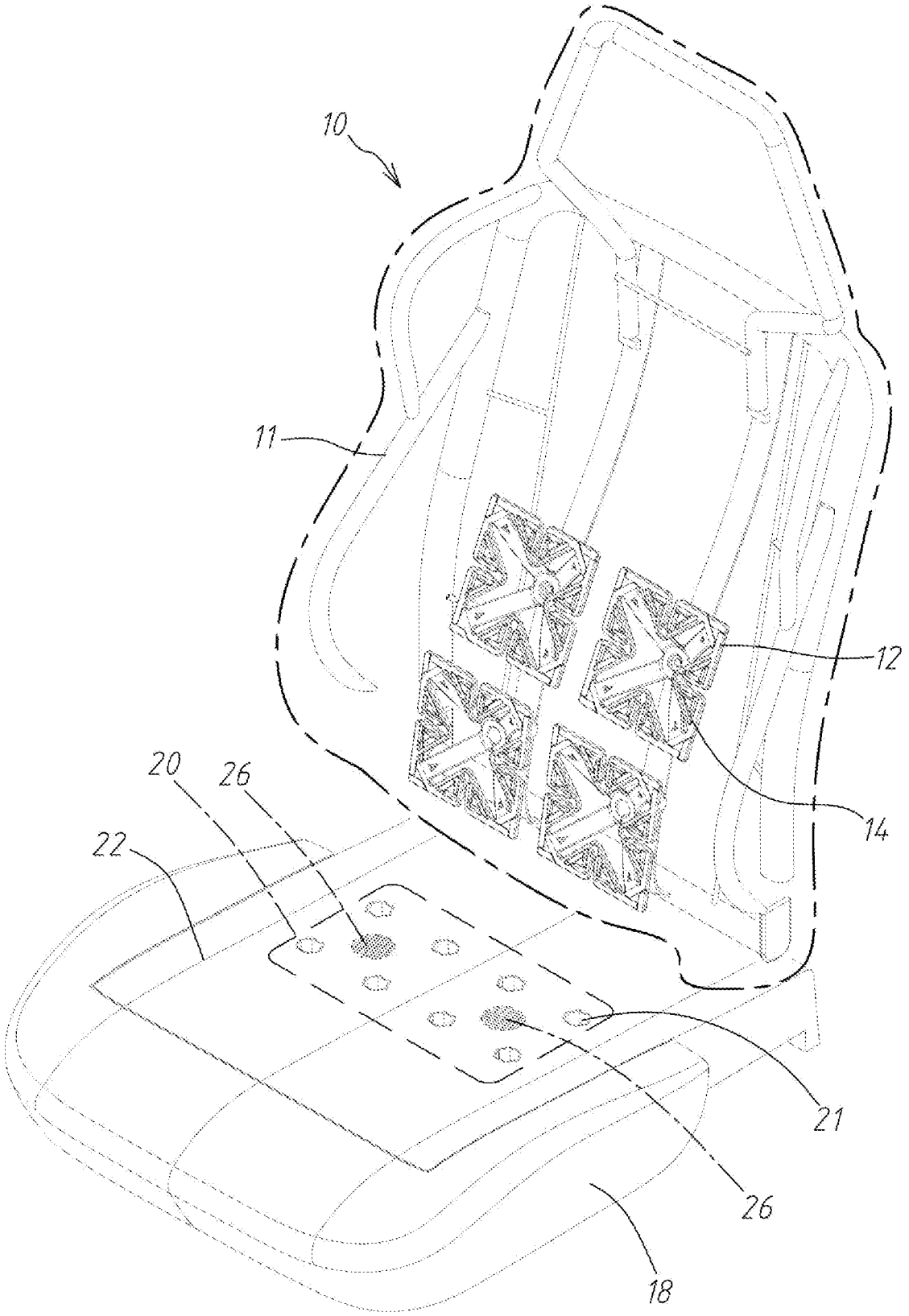
FIG. 1 is a perspective view schematically showing a waist support chair according to one embodiment of the present invention.

The present invention provides a waist support chair. Refer to FIG. 1, which is a perspective view schematically showing a waist support chair according to one embodiment of the present invention. The waist support chair 10 of the present invention comprises a framework, a back support member, and a hips support member 20. The framework includes a back support frame 11 and a chair bottom 18 pivotally coupled to each other. A back cushion (not shown in the drawing) is arranged on the seating side of the back support frame. A hips cushion 22 is arranged on the seating side of the chair bottom 18. The back cushion and the hips cushion 22 may be made of a material selected from a group including foam materials, memory foam materials, and other soft and resilient materials. The back support member is arranged on the back support frame 11 and between the back cushion and the back support frame 11 for supporting the lower back of the human body. The back support member includes two upper support elements 12 horizontally disposed and left-right symmetric to each other. Also, the back support member includes two lower support elements 14 horizontally disposed and left-right symmetric to each other. Two lower support elements 14 are disposed between two upper support elements 12 and the chair bottom 18. The hips support member 20 is arranged on the chair bottom 18 to support the hips of the human body and make the sitter feel comfortable. The structures and efficacies of the back support member and the hips support member 20 are described in detail below.

Figure 2:
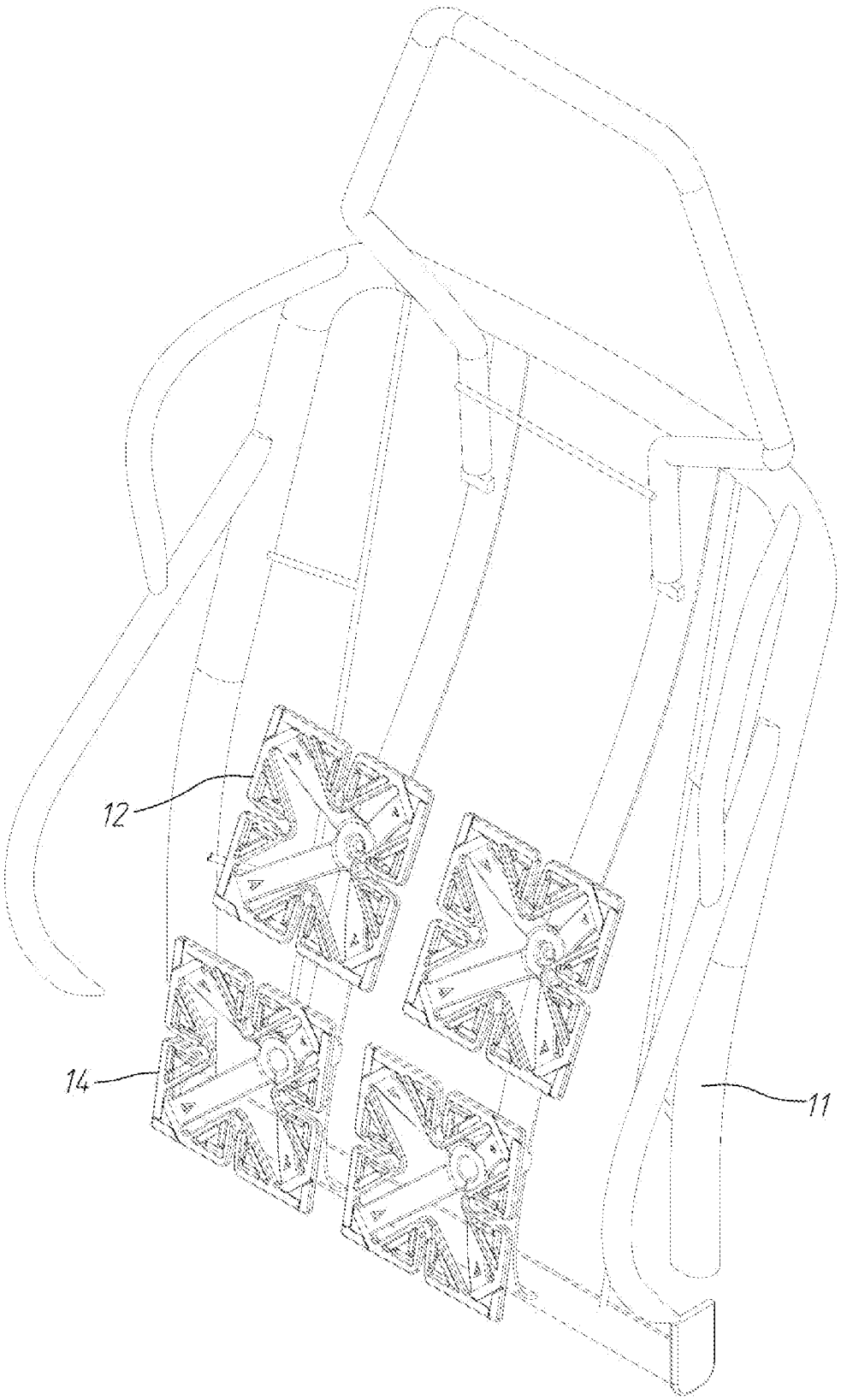
FIG. 2 is a local perspective view schematically showing a back support member of a waist support chair according to one embodiment of the present invention.

Firstly is described the back support member. Refer to FIG. 2, which is a local perspective view schematically showing a back support member of a waist support chair according to one embodiment of the present invention. The back support member includes two upper support elements 12 and two lower support elements 14. The upper support elements 12 corresponds to the back of the human body. The lower support elements 14 correspond to the rear waist of the human body. Two upper support elements 12 are horizontally disposed and symmetric to each other. Two lower support elements 14 are also horizontally disposed and symmetric to each other. Two upper support elements 12 and two lower support elements 14 support two sides of the backbone of the human body. Note that, in the present invention, instead of having a long support bar respectively, the upper region and the lower region both have two support elements being left-right symmetric. Therefore, the present invention can provide a better intimate and compliant support effect for users of different body shapes.

Figure 3:
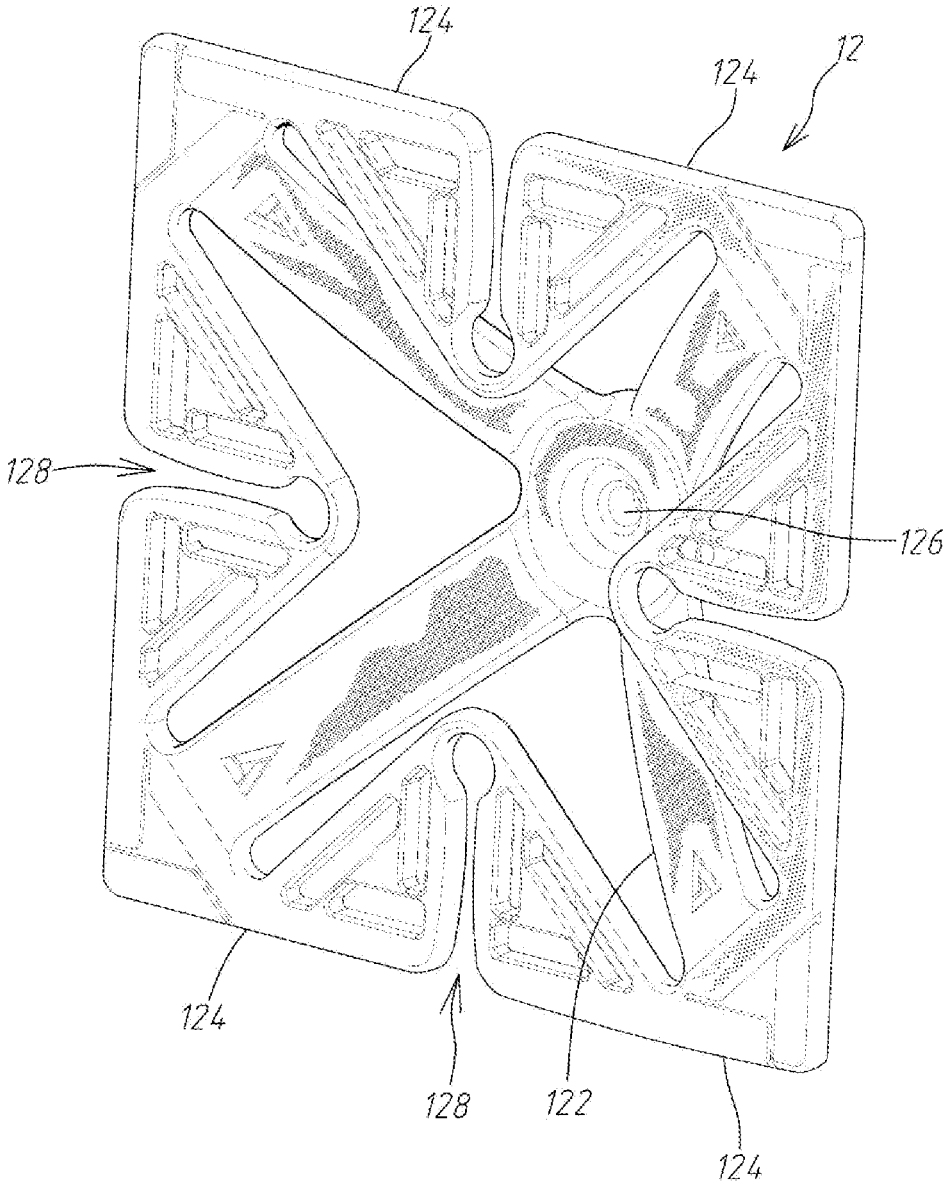
FIG. 3 is a perspective view schematically showing an upper support element of a waist support chair according to one embodiment of the present invention.
Figure 4:
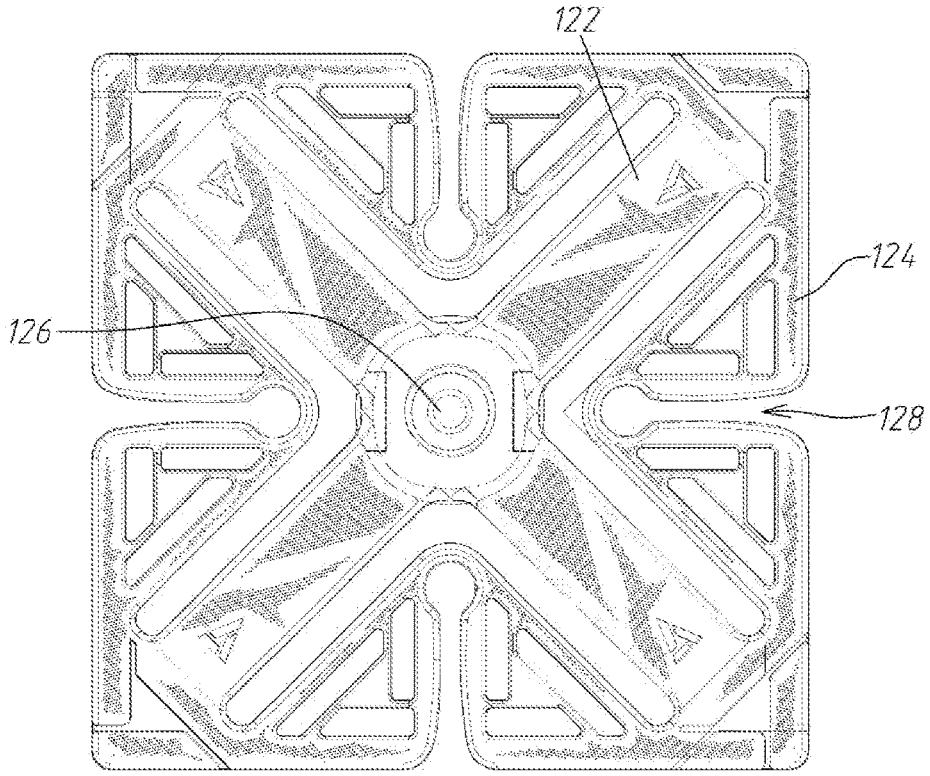
FIG. 4 is a rear view schematically showing an upper support element of a waist support chair according to one embodiment of the present invention.
Figure 5:
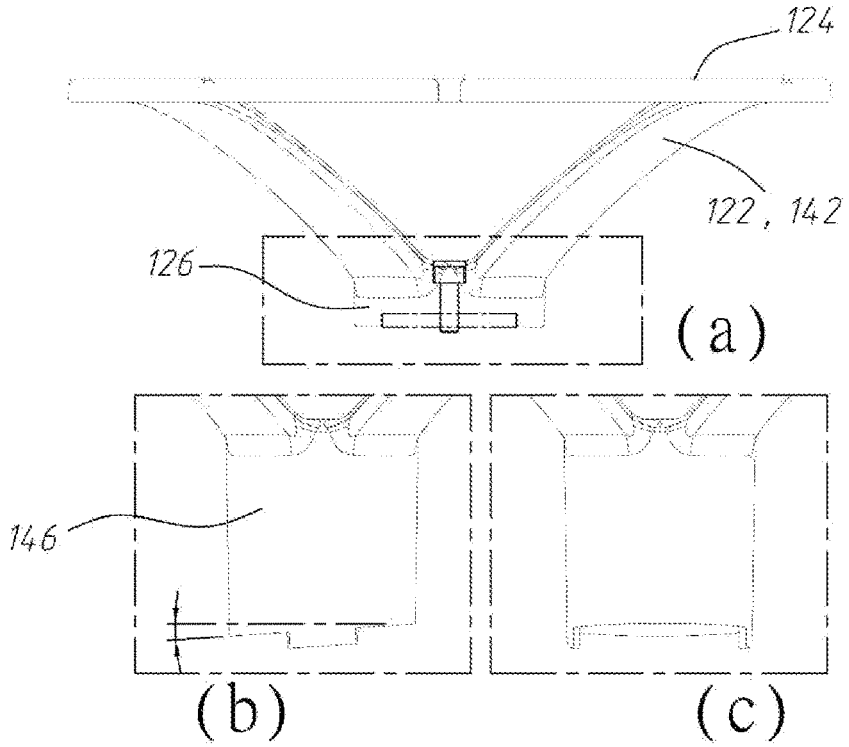
FIG. 5 is a side view schematically showing an upper support element and a lower support element of a waist support chair according to embodiments of the present invention.

Refer to FIGS. 3-5. FIG. 3 is a perspective view schematically showing an upper support element of a waist support chair according to one embodiment of the present invention. FIG. 4 is a rear view schematically showing an upper support element of a waist support chair according to one embodiment of the present invention. FIG. 5 is a side view schematically showing an upper support element and a lower support element of a waist support chair according to embodiments of the present invention. Each upper support element 12 includes a plurality of elastic support bands 122, a plurality of support planes 124, and an upper connection portion 126. The upper connection portion 126 is fixed to the back support frame 11. The support planes 124 intimately contact the back cushion. One end of the elastic support band 122 is connected with the upper connection portion 126, and the other end of the elastic support band 122 is connected with a corresponding support plane 124. A plurality of slots is used to form the support planes 124. The numbers of the elastic support bands 122, the support planes 124, and the slots 128 are the same. In the example of FIG. 4, four slots 128 are used to partition an integral plane into four support planes 124. The rear side of each support plane 124 is connected with one elastic support band 122. Similarly, each lower support element 14 includes a plurality of elastic support bands 142, a plurality of support planes 144, and a lower connection portion 146. A person skilled in the art should understand that the connection and operation of the elastic support bands 142, the support planes 144, and the lower connection portion 146 are similar to those of the elastic support bands 122, the support planes 124, and the upper connection portion 126.

Figure 7:
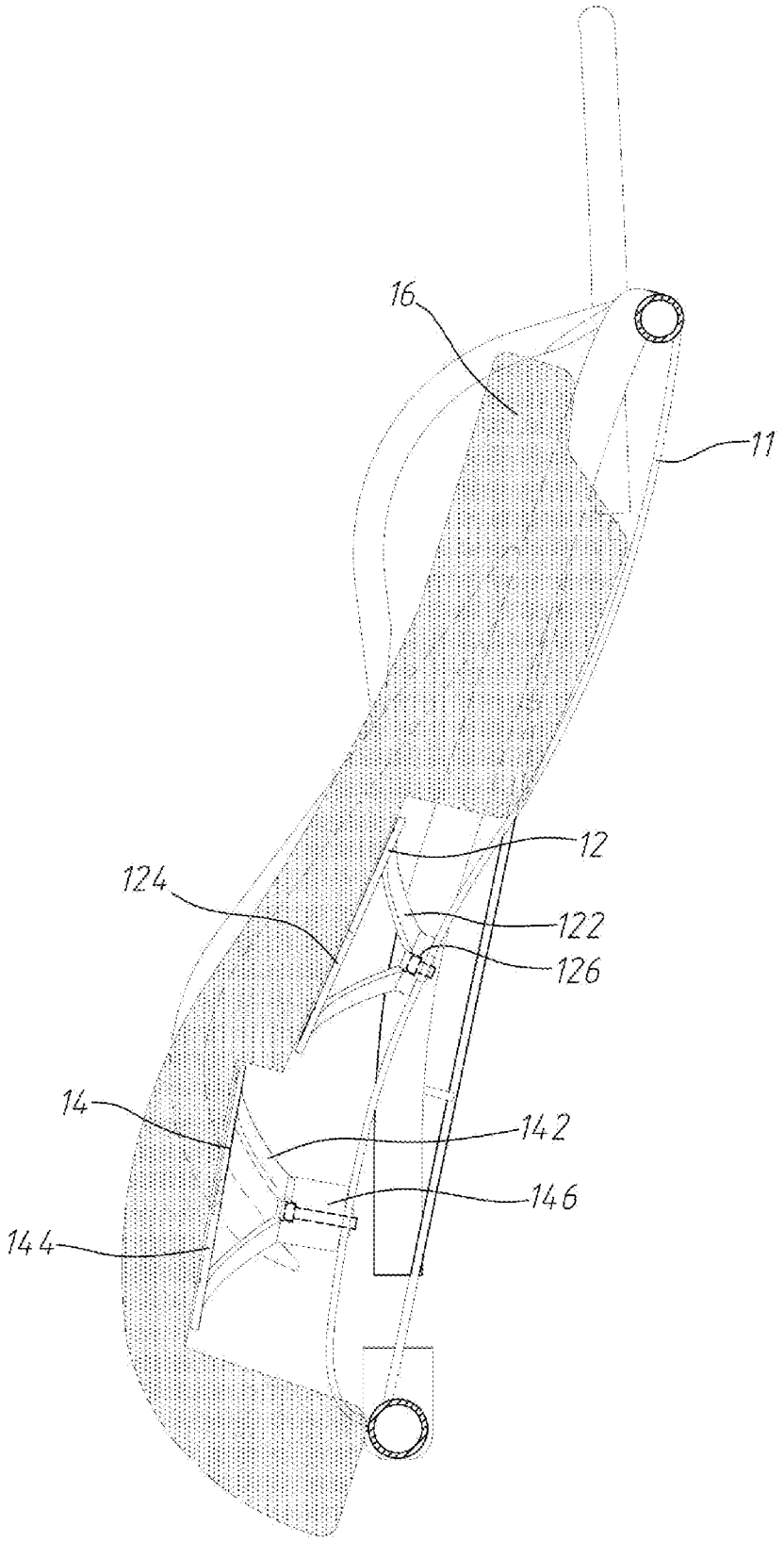
FIG. 7 is a side view schematically showing the back region of the waist support chair according to one embodiment of the present invention.

FIG. 5 shows an embodiment of the upper connection portion 126 in Section (a) and embodiments of the lower connection portion 146 in Section (b) and Section (c). The upper connection portion 126 is shorter, and the lower connection portion 146 is longer. The embodiments of the lower connection portion 146 include a planar pattern (Section (c)) and an oblique pattern (Section (b)). The abovementioned embodiments and patterns are to be adapted to the shapes of the back support frame 11 and the back cushion. However, the present invention is not limited by the abovementioned embodiments. Refer to FIG. 7, which is a side view schematically showing the back region of the waist support chair according to one embodiment of the present invention. The support planes 124 of the upper support elements 12 and the support planes 144 of the lower support elements 14 may be faced at different angles, thereby supporting the back cushion 16. Because different regions of the back cushion 16 are not equidistant to the back support frame 11, the upper connection portion 126 and the lower connection portion 146 have different lengths. In some situations, the shape of the upper connection portion 126 and the shape of the lower connection portion 146 may be identical.

Figure 6:
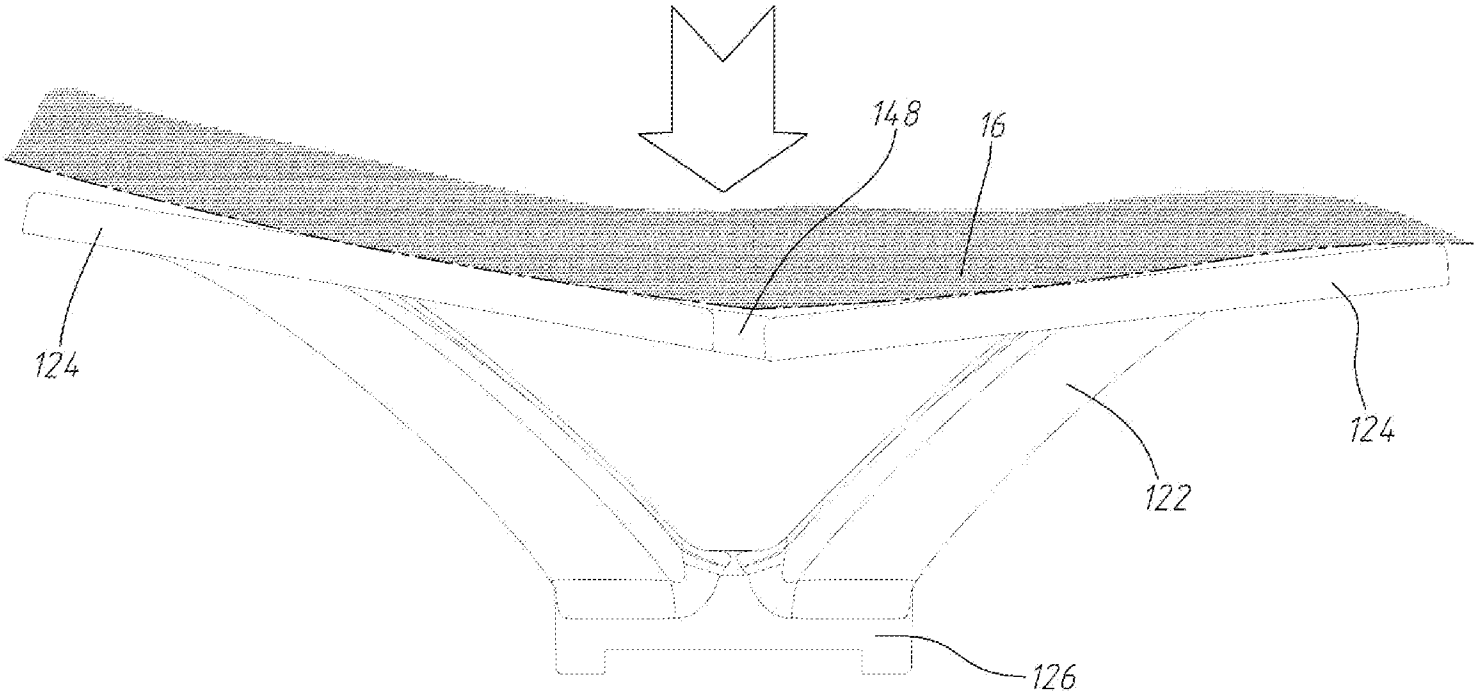
FIG. 6 is a diagram schematically showing the pressurized upper support element of the waist support chair according to one embodiment of the present invention.

Refer to FIG. 6, which is a diagram schematically showing the pressurized upper support element of the waist support chair according to one embodiment of the present invention. When pressure is applied to any one of the support planes 124, the pressurized support plane 124 moves backward, and the elastic support band 122 corresponding to the pressurized support plane 124 is bent and then feeds back a counterforce to the pressurized support plane 124. As shown in FIG. 6, the support planes 124 are not on the same level surface but at different angles corresponding to the acting forces.

Figure 8:
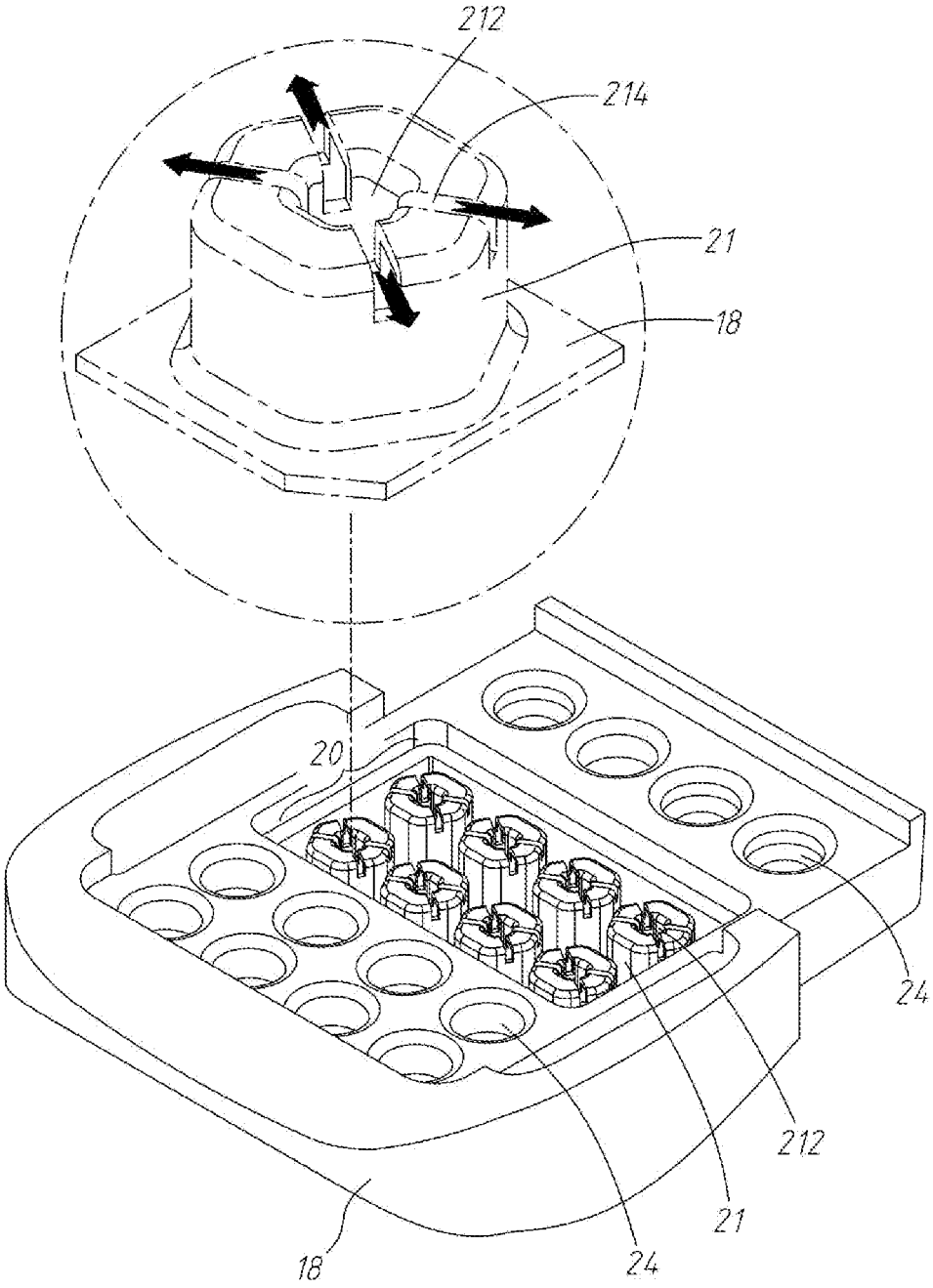
FIG. 8 includes a perspective view schematically showing a seating region of the waist support chair and an enlarged view schematically showing hollow elastic columns according to embodiments of the present invention.
Figure 9:
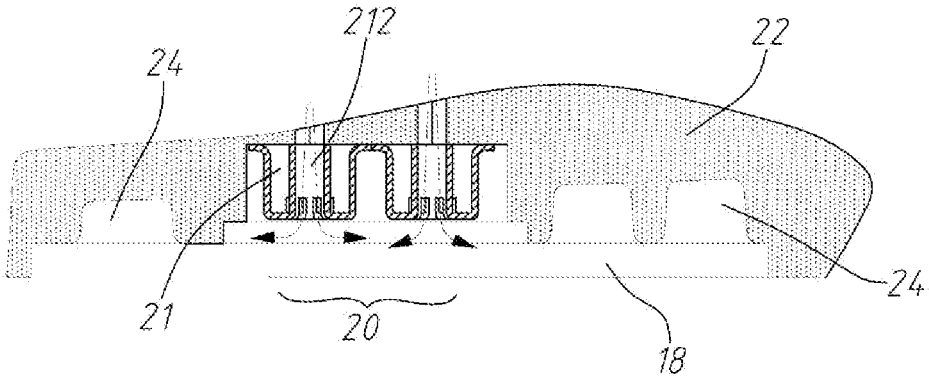
FIG. 9 is a sectional side view schematically showing a seating region of the waist support chair according to one embodiment of the present invention.
Figure 10:
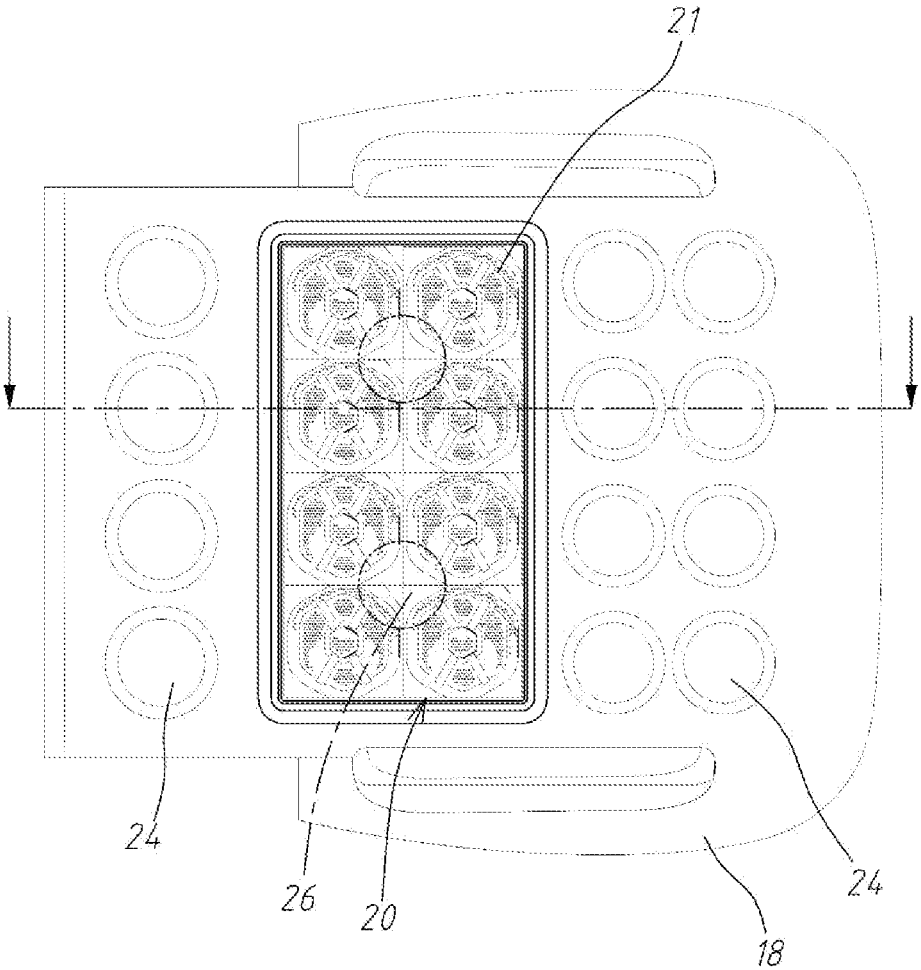
FIG. 10 is a top view schematically showing a seating region of the waist support chair according to one embodiment of the present invention.

Next, refer to FIGS. 8-10. FIG. 8 is a perspective view schematically showing a seating region of the waist support chair and an enlarged view schematically showing a hollow elastic column according to embodiments of the present invention. FIG. 9 is a sectional side view schematically showing a seating region of the waist support chair according to one embodiment of the present invention. FIG. 10 is a top view schematically showing a seating region of the waist support chair according to one embodiment of the present invention.

The hips support member 20 includes a plurality of hollow elastic columns 21. One end of the hollow elastic column 21 is arranged on the chair bottom 18, and the other end of the hollow elastic column 21 contacts the hips cushion 22. The hollow elastic column 21 is made of a memory foam material, used to support the hips of the human body and compressed to release air while pressurized. In one embodiment, the hollow elastic columns 21 are in form of hexagonal prisms, vertical to the chair bottom 18, and arranged in array. Each hollow elastic column 21 includes an air-release hole 212 and a plurality of air-release branch holes 214. The air-release hole 212 travels along the central axis of the hollow elastic column 21 until it contacts the chair bottom 18. The air-release branch holes 214 are arranged on the hollow elastic column 21 and positioned at one end of the hollow elastic column 21, which is far away from the chair bottom 18, i.e., on the surface contacting the hips cushion 22. FIG. 8 is an enlarged view schematically showing the air-release hole 212, in which the four arrows indicate the directions of the air flows. As shown in FIG. 8, the air-release branch holes 214 interconnect with the air-release hole 212 and extend outward with the air-release hole 212 being the axis to form a plurality of airflow channels. When a person sits on the hips cushion 22, the person's weight applies force to the hollow elastic columns 21. Thus, the hollow elastic columns 21 are compressed to release air, and the air is exhausted from the air-release hole 212 and the air-release branch holes 214. The gap among four neighboring hollow elastic columns 21 forms an ischium support point 26. The eight hollow elastic columns 21 in FIG. 8 have two ischium support points 26, which exactly provide support for the corresponding ischia.

The chair bottom 18 further includes a plurality of ventilation holes 24 respectively penetrating the chair bottom 18. The openings of the ventilation holes 24 face the hips cushion 22. The ventilation holes 24 may be used to dissipate heat, whereby the person sitting on the hips cushion 22 feels more comfortable.

In conclusion, the present invention proposes a waist support chair with an upper support element and a lower support element for respectively supporting the back and the rear waist of the human body. The upper support element and the lower support element are in left-right symmetry and can contact the back and waist more intimately and compliantly. Further, the present invention arranges a plurality of vertical hollow elastic columns on the bottom of the chair to support the hips of the sitter. When a force is applied to the hollow elastic columns, the hollow elastic columns are compressed to release air. Hence, the person sitting on the hips cushion feel more comfortable.

It should be pointed out that the embodiments described above are only to exemplify the present invention but not to limit the scope of the present invention. The modifications or variations made by the persons skilled in the art according to the spirit of the present invention would not depart from the present invention and should be included in the scope of the present invention.

What is claimed is:

1. A waist support chair, comprising:

a framework comprising a back support frame and a chair bottom, pivotally coupled to each other;

a back support member, arranged on the back support frame and adjacent to the chair bottom and comprising two upper support elements horizontally disposed and left-right symmetric to each other and two lower support elements also horizontally disposed and left-right symmetric to each other, wherein the lower support elements are disposed between the upper support elements and the chair bottom; and a hips support member, arranged on the chair bottom and comprising a plurality of hollow elastic columns, wherein the hollow elastic columns are compressed to release air while the hollow elastic columns are pressurized;

wherein one end of each of the hollow elastic columns is arranged on the chair bottom, and each of the hollow elastic columns includes:

an air-release hole, traveling through a central axis of the hollow elastic column; and a plurality of air-release branch holes, arranged on a surface of one end of the hollow elastic column, which is far away from the chair bottom, interconnecting with the air-release hole, and extended outward with the air-release hole being an axis to form a plurality of air flow channels.

2. The waist support chair according to claim 1, wherein a back cushion is arranged on one side of the back support frame, and a hips cushion is arranged on one side of the chair bottom.

3. The waist support chair according to claim 2, wherein the upper support elements are arranged between the back cushion and the back support frame, and each of the upper support elements includes:

an upper connection portion, fixed to the back support frame;

a plurality of support planes, intimately contacting the back cushion to support the back cushion; and a plurality of elastic support bands, wherein one end of each of the elastic support bands is connected with the upper connection portion, and the other end of each of the elastic support bands is connected with a corresponding one of the support planes;

when any one of the support planes is applied with pressure, the support plane moves backward, and the elastic support bands corresponding to the support plane are bent and feeds back a counterforce to the support plane.

4. The waist support chair according to claim 3, wherein a plurality of slots is used to partition an integral plane into the plurality of support planes, and a quantity of the slots corresponds to a quantity of the support planes.

5. The waist support chair according to claim 2, wherein the lower support elements are arranged between the back cushion and the back support frame, and each of the lower support elements includes:

a lower connection portion, fixed to the back support frame;

a plurality of support planes, intimately contacting the back cushion to support the back cushion; and a plurality of elastic support bands, wherein one end of each elastic support bands is connected with the lower connection portion, and the other end of each elastic support bands is connected with a corresponding one of the support planes; when any one of the support planes is applied with pressure, the support plane is moves backward, and the elastic support bands corresponding to the support plane are bent and feeds back a counterforce to the pressurized support plane.

6. The waist support chair according to claim 5, wherein a plurality of slots is used to partition an integral plane into the plurality of support planes, and a quantity of the slots corresponds to a quantity of the support planes.

7. The waist support chair according to claim 2, wherein the chair bottom comprises a plurality of ventilation holes, and each of the ventilation holes has an opening facing the hips cushion and penetrating the chair bottom.

8. The waist support chair according to claim 1, wherein the hollow elastic columns are disposed in array and vertical to the chair bottom.

9. The waist support chair according to claim 1, wherein the hollow elastic columns are in form of hexagonal prisms.

10. The waist support chair according to claim 1, wherein four of the hollow elastic columns that are adjacent form a gap therebetween, wherein the gap is configured as an ischium support point.

* * * * *